United States Patent [19]

Schweyen

[11] Patent Number: 4,663,223

[45] Date of Patent: May 5, 1987

[54] TEARABLE FLEXIBLE COATED ABRASIVE PRODUCT

[75] Inventor: Paul R. Schweyen, Tonawanda, N.Y.

[73] Assignee: Carborundum Abrasives Company, Niagara Falls, N.Y.

[21] Appl. No.: 766,055

[22] Filed: Aug. 15, 1985

[51] Int. Cl.[4] ..... B32B 5/16

[52] U.S. Cl. ..... 428/240; 51/298; 51/306; 51/DIG. 19; 428/241; 428/242; 428/258; 428/259

[58] Field of Search ..... 428/240, 241, 242, 258, 428/259; 51/298, 306, DIG. 19

[56] References Cited

U.S. PATENT DOCUMENTS 4,439,482 3/1984 Suematsu ..... 428/259

4,553,982 11/1985 Korbel et al. ..... 428/241

*Primary Examiner*—Marion C. McCamish

*Attorney, Agent, or Firm*—Donald C. Studley; Michael L. Dunn

[57] ABSTRACT

The present invention provides a flexible, coated abrasive product having a fabric or cloth substrate. The fabric has a warp direction and a fill direction and is preferably woven. The finished coated abrasive product is manually tearable in the warp direction in a straight line. The product is characterized by having a tear strength across the warp direction that is at least twice the tear strength across the fill direction. Tearing of the present products takes place along, or contiguous to, a single yarn in the warp direction. The coated abrasive product of the invention is particularly useful in the form of belts, elongated sheets or rolls.

11 Claims, No Drawings

TEARABLE FLEXIBLE COATED ABRASIVE PRODUCT

FIELD OF THE INVENTION

The present invention relates to manually tearable coated abrasive products. More particularly the present invention relates to flexible coated abrasive products which are manually tearable in a straight, lengthwise direction.

In recent years, many applications have been developed that require the use of coated abrasives, particularly in the form of belts, that have hard, tough and sharp cutting edges, for example, in the working of wood to produce moulding or other products having contoured surfaces. The use of the belt edge results in a rapid wearing away of the cutting surface as compared to the usual use of the flat surface of the belt. As a consequence belts used in this manner require frequent changing. Although belts of narrower width are employed to reduce the amount of abrasive surface wasted after the belt edges are worn, the inconvenience and loss of manpower because of frequent belt changes remain to be remedied.

Typically coated abrasive belt substrates are designed and fabricated with the strength in the warp direction slightly greater, or equal to, the strength, in the fill direction. Such design is utilized to obtain a desired dimensional stability and to minimize elongation of the belt. However, attempts to manually split such belts to expose new cutting edges, or faces, almost invariably results in uncontrolled tearing which proceeds in various directions and results in spoilage of the belt. Further, the belts of the prior art are made with great care to be highly resistant to tear by forces substantially greater than manual force.

Coated abrasives typically consist of a flexible backing upon which films of adhesive hold and support a layer of abrasive grains. The abrasives most generally used as aluminum oxide, silicon carbide, garnet, flint, emery and crocus. Methods for the production of coated abrasives and coated abrasive products are described in U.S. Pat. Nos. 3,053,020; 3,787,273; 4,225,321; and 4,345,545. The teachings of these references are incorporated herein by reference.

BRIEF DESCRIPTION OF THE INVENTION

The present invention provides a flexible, coated abrasive product having a fabric, or cloth, substrate. The fabric has a warp direction and a fill direction and is preferably woven. The finished coated abrasive product is manually tearable in the warp direction in a straight line. The product is characterized by having a tear strength across the warp direction that is at least twice the tear strength across the fill direction. Tearing of the present product takes place along, or contiguous to, a single yarn in the warp direction. The coated abrasive product of the invention is particularly useful in the form of belts, elongated sheets or rolls.

In a number of industrial applications, it is desirable to reduce the width of a partially used, but still useful, belt in order to expose a fresh cutting edge. In accord with the present invention, an incision, or cut, is made through the belt splice, for example, a butt or a lap splice, using a knife or other suitable cutting tool. The cut is made parallel to the warp yarn and at a desired distance from the used edge. The cut is then manually extended by tearing. The tear extends in a straight lengthwise direction with no excursions across the warp yarn during the tearing operation. At the end of the tearing operation the tear merges with the original cut forming a new, smooth, continuous cutting edge. In a similar manner elongated sheets or rolls may be reduced in size or divided into strips. If the item to be torn does not have a joined section, i.e., is an integral piece, the initial incision, or cut, may be made at any point parallel to the warp yarn and extended in either direction by manual tearing.

It will be appreciated that the present invention provides for the continued use of abrasive belts which otherwise would be discarded. Further, the width of the belt portion removed may be adjusted to yield a usable belt having no cutting edge, i.e., the splitting or tearing process may easily be adjusted to produce two new cutting edges, one on the portion removed and one on the original belt.

DETAILED DESCRIPTION AND PREFERRED EMBODIMENTS OF THE INVENTION

The coated abrasive products of the present invention are manually tearable in the lengthwise, or warp direction. Once initiated, the tear can be propagated at a load level within the physical strength of an individual.

Woven fabrics in general are suited to use as backings for the present coated abrasive products, provided they have a tear strength, or resistance, across the warp direction that is at least two times the tear strength, or resistance, across the fill direction. The fabrics must also have a minimum resistance to tearing along the warp direction to prevent splitting during use. The amount of such minimum resistance may be determined empirically by testing under the specific use conditions.

The woven fabric suitable for use in the present coated abrasives may be of various weaves, for example, plain weave, typically 1/1; twill, typically 2/1; or sateen, typically 4/1. The ratios indicate the over/under path of the fill yarn. Fabrics of a sateen, jean or drill construction are commonly used as coated abrasive backing. Suitable fabrics may be of maximum construction, that is, for a given set of warp and fill yarns, the maximum amount of yarn that can be woven into the construction without buckling or jamming during weaving is employed.

The fabric backing materials useful in the present invention may be engineered in several ways. If the fabric yarns are of equal or substantially equal strengths, the thread count can be adjusted. For example, the thread count of the warp yarns can be increased to a number greater than the fill yarns. Alternatively, the thread count in the fill yarns may be decreased to be less than the warp yarns. In either of such instances the tearing strength of the fabric is suitably shifted to the warp direction.

Alternatively, the fibers which make up the yarn may be varied. Stronger fabrics, that is those of higher tenacity, may suitably be used in the yarns running in the warp direction while weaker fibers, those with regular tenacity, or low tenacity, may be used in the yarns running in the fill direction. Blends of fibers may be utilized to vary the yarn strength. Polyester, nylon and rayon yarns, are commonly available in high tenacity and regular tenacity grades and are aptly suited to use. Various blends of such yarns with cotton are also commercially available and are also suited to use.

A further alternative which may be used to obtain the desired directional strength difference is to strengthen the warp yarn systems by employing plied yarns in the warp direction usually two to four single yarns twisted together to make a single plied yarn, or two single warp yarns laid in side by side. In such cases a suitable fill yarn system would utilize either single yarns, e.g., not plied, or a lesser plied yarn.

Various combinations of the means described above may be employed to obtain the desired tearing characteristics and tear strength ratio of warp to fill direction that is required by the present invention.

The following specific examples of the invention are to be interpreted as illustrative and not limiting.

A plain weave fabric, 1/1, was engineered having warp yarns comprised of a blend of 65 weight percent polyester fiber and 35 weight percent cotton. The fill yarns of the fabric were 100 percent cotton. The yarn in the warp direction had a size of 22 c.c. (cotton count yarn number system) and in the fill direction a size of 17.5 c.c. The thread count was 68 ends/inch (warp direction) and 42 picks/inch (fill direction). The fabric weight was 4.14 oz/yd$^2$.

The fabric was then washed, rinsed, placed on a tenter and dried. Subsequently portions were cloth finished with acrylic latex compositions, using known finishing techniques. A make coat of phenolic resin was then applied to the finished fabric substrate using prior art processing techniques. A layer of aluminum oxide grain (grit size 120) was next deposited on the make coat. A size coat was then deposited over the aluminum oxide grain layer. The coatings were subsequently cured to produce a coated abrasive product.

Although acrylic latexes and phenolic resins were used in the various coatings of this example, other latexes and other resins could suitably be utilized. A number of resins and resin compositions useful as the back, make and size coats are described in U.S. Pat. No. 4,074,903.

The tear strength of the coated abrasive products was determined using an Elmendorf tearing tester. The Elmendorf tear test employs a pendulum to apply energy sufficient to tear through a fixed length of fabric. The tear is a single-rip tongue-type tear. The tester consists of a sector-shaped pendulum, carrying a clamp which is in alignment with a fixed clamp when the pendulum is in the raised, starting position having maximum potential energy. A rectangular fabric specimen is fastened in the clamps and a slit made to start the tear. The pendulum is then released and the specimen tears as the moving jaw separates from the fixed jaw. The energy required to tear is the potential energy difference at the beginning and end of the pendulum swing, and is measured by the position of the pendulum at the end of the test.

The tear character of the products shown in the following tables was determined by making an initial slit in the coated abrasive and subsequently manually propagating the tear. The coated abrasive products shown in Table I tore lengthwise (in the warp direction) in a straight line following a single warp yarn. Thus, in Example 1, Table I a coated abrasive product having a 1/1 plain weave fabric backing, as substrate, was tested. The fabric substrate had warp yarns of a blend of 65 weight percent polyester fiber and 35 weight percent cotton. The fill yarns were 100 percent cotton. The warp direction yarn had a size of 22 c.c.; the fill direction yarn had a size of 17.5 c.c. The thread count was 68 ends/inch and 28 picks/inch. The fabric weight was 4.14 oz./yd.$^2$. The product was tested on an Elmendorf tester and found to have an average tear strength across the fill yarns of 600 grams and an average tear strength across the warp yarn of 1275 grams. The ratio of the tearing strength of the warp to fill direction was 2.12. The path of the tear was a straight line along a single warp yarn. Examples 2 through 4 of Table I were run in a similar manner.

A second series of tests were conducted using a similar procedure. These are shown as Examples 1 through 4 of Table II. Thus, in Example 1 of Table II, a 2/1 twill weave fabric of 100% cotton having a thread count of 62 ends/inch × 56 picks/inch was utilized as the coated abrasive substrate. The size of the warp yarn was 16.5 c.c.; the size of the fill yarn was 25.0 c.c. The fabric weight was 4.78 oz/yd$^2$. The fabric substrate was coated and the tearing strength of the coated abrasive product tested as described above. The product was found to have an average tear strength across the fill yarn of 480 grams and an average tear strength across the warp yarn of 895 grams. The ratio of tearing strength of the warp to fill direction was 1.87. The tear unpredictably propagated over and through warp yarns resulting in a ragged and jagged tear character. Examples 2 through 4 of Table II were carried out in a similar manner.

TABLE I

| | Elmendorf Test Results | | | |
|---|---|---|---|---|
| Example | Across Fill Yarns | Across Warp Yarns | Ratio Warp/Fill | Tear Character |
| 1 | 600 | 1275 | 2.12 | Straight line |
| 2 | 775 | 2075 | 2.68 | Straight line |
| 3 | 800 | 1725 | 2.16 | Straight line |
| 4 | 650 | 1600 | 2.46 | Straight line |

TABLE II

| | Elmendorf Test Results | | | |
|---|---|---|---|---|
| Example | Across Fill Yarns | Across Warp Yarns | Ratio Warp/Fill | Tear Character |
| 1 | 480 | 895 | 1.87 | Ragged & jagged |
| 2 | 720 | 1065 | 1.48 | Ragged & jagged |
| 3 | 700 | 960 | 1.37 | Ragged & jagged |
| 4 | 635 | 870 | 1.37 | Ragged & jagged |

What is claimed is:

1. A flexible, woven, fabric backed coated abrasive product, said fabric having a warp direction and a fill direction, said product manually tearable in a straight line in the warp direction, said product having a tear strength across the warp direction at least twice the tear strength across the fill direction.

2. The product of claim 1 wherein the product is manually tearable along a single yarn in the warp direction.

3. The product of claim 1 wherein the product is in the form of a belt.

4. The product of claim 1 wherein the product is in the form of an elongated sheet.

5. The product of claim 1 wherein the product is in the form of a roll.

6. The product of claim 1 wherein said fabric is comprised of yarns having equal or substantially equal strength and has a higher thread count in the warp direction than in the fill direction.

7. The product of claim 1 wherein the fabric yarns running in the warp direction have a higher tenacity than the fabric yarns running in the fill direction.

8. The product of claim 1 wherein the fabric yarns running in the warp direction are plied yarns and the fabric yarns running in the fill direction are not plied.

9. The product of claim 1 wherein the construction of the fabric is a plain weave.

10. The product of claim 1 wherein the construction of the fabric is a twill weave.

11. The product of claim 1 wherein the construction of the fabric is a sateen weave.

* * * * *